US005667358A

United States Patent [19]

Gaul

[11] Patent Number: 5,667,358

[45] Date of Patent: Sep. 16, 1997

[54] METHOD FOR REDUCING STEADY STATE ROTOR BLADE TIP CLEARANCE IN A LAND-BASED GAS TURBINE TO IMPROVE EFFICIENCY

[75] Inventor: Gregory R. Gaul, Orlando, Fla.

[73] Assignee: Westinghouse Electric Corporation, Pittsburgh, Pa.

[21] Appl. No.: 565,748

[22] Filed: Nov. 30, 1995

[51] Int. Cl.[6] ..... F01D 5/20

[52] U.S. Cl. ..... 415/173.2; 415/173.1

[58] Field of Search ..... 415/173.1, 173.2

[56] References Cited

U.S. PATENT DOCUMENTS

| | | | |
|---|---|---|---|
| 2,994,472 | 8/1961 | Botje . | |
| 3,227,418 | 1/1966 | West . | |
| 4,171,614 | 10/1979 | Weiler | 60/39.36 |
| 4,439,982 | 4/1984 | Weiler et al. | 60/39.32 |
| 5,056,988 | 10/1991 | Corsmeier et al. | 415/173.2 |
| 5,219,268 | 6/1993 | Johnson | 415/115 |
| 5,228,828 | 7/1993 | Damlis e tal. | 415/173.2 |
| 5,281,085 | 1/1994 | Lenahan et al. | 415/173.2 |
| 5,295,787 | 3/1994 | Leonard et al. | 415/173.3 |

*Primary Examiner*—John T. Kwon

[57] ABSTRACT

Disclosed is a method for improving the efficiency of a land-based gas turbine by controlling the blade tip clearance. The diameter of the outer gas path casing is increased during transient periods. The outer casing is heated during transient periods to increase its diameter and the associated blade tip clearance thereby allowing for a reduced cold tip clearance and and conseuently steady-state running clearance.

15 Claims, 3 Drawing Sheets

METHOD FOR REDUCING STEADY STATE ROTOR BLADE TIP CLEARANCE IN A LAND-BASED GAS TURBINE TO IMPROVE EFFICIENCY

BACKGROUND OF THE INVENTION

The present invention relates generally to gas turbines, and more particularly a method, apparatus, and system for improving the efficiency of a land-based gas turbine by controlling the blade tip clearance. In a presently preferred embodiment of the invention, the blade tip clearance is reduced by heating a blade ring during a transient, non-steady state, period of operation of the turbine to increase the blade tip clearance during that period.

A gas turbine engine includes a rotary compressor for compressing the air flow entering the engine, a combustor in which a mixture of fuel and compressed air is burned to generate a propulsive gas flow, and a turbine that is rotated by the propulsive gas flow and is connected by a shaft to drive the compressor. The efficiency of a gas turbine depends in part on the clearance between the rotor blade tips and the surrounding engine casing or shroud, such as the clearance between the engine's turbine blades and the engine's turbine casing and the clearance between the engine's compressor blades and the engine's compressor casing. If the clearance is too large, more of the engine air flow will leak through the gap between the rotor blade tips and the surrounding shroud, decreasing the engine's efficiency. If the clearance is too small, the rotor blade tips may strike the surrounding shroud during certain engine operating conditions. Further background information is provided by U.S. Pat. No. 5,228,828, Jul. 20, 1993, titled "Gas Turbine Engine Clearance Control Apparatus" (Damlis et al.); U.S. Pat. No. 5,295,787, Mar. 22, 1994, titled "Turbine Engines" (Leonard et al.); and U.S. Pat. No. 5,219,268, Jun. 15, 1993, titled "Gas Turbine Engine Case Thermal Control Flange" (Johnson).

Typically, the cold clearance between the rotor blade tip and adjacent flow path outer diameter is set to minimize tip clearance during steady state and to avoid tip rubs during transient periods. A transient period, such as during a fast start, typically dictates the cold setting, and consequently the steady state tip clearance is greater than the minimum clearance possible. This results in extra leakage past the blades and reduced efficiency,.

A goal of the present invention is to improve on this situation by controlling the flow path outer diameter to increase the blade tip clearance during transients, and to thereby provide a reduced cold clearance and, consequently, a reduced steady state clearance with its associated efficiency improvement.

SUMMARY OF THE INVENTION

Accordingly, the present invention relates to a method for improving the efficiency of a gas turbine through the active (non-steady state) control of rotor blade tip clearance. By controlling tip clearance in the manner disclosed below, leakage past blades during steady state can be reduced while preventing tip rubs during transients.

The invention disclosed herein maintains tip clearance by thermally controlling the diameter of a ring supporting the outer diameter of the flow path. The outer casing support ring is heated during transient periods to provide additional tip clearance at the cycle minimum. As a result, the cold clearance and the associated hot/steady state tip clearance can be reduced while still avoiding tip rubs. Since the heating medium is only applied during the transient period, the steady state performance is not compromised.

Active tip clearance control (ATCC) systems are typically designed for aeroturbines and attempt to match the stationary shroud response to the rotor throughout the transients. Since large land-based gas turbines typically start up and run for an extended time, the transient tip clearance is not a significant concern. The present invention reduces tip clearance only at steady state. Since no heating medium is applied at steady state, there is no performance penalty. Because of this, it is believed that the present invention is distinguished from conventional ATCC systems.

Other features of the invention are described below.

DETAILED DESCRIPTION OF PREFERRED EMBODIMENTS

As mentioned above, the present invention minimizes blade tip clearance, particularly in land-based turbines, during steady state. This is accomplished by setting the cold clearance between the rotor blade tip and adjacent flow path outer diameter such that the latter (outer diameter) is increased (e.g., by thermal expansion) during transient periods (e.g., a fast start) to avoid tip rubs during those periods. This permits the use of a reduced cold clearance and a tighter steady state clearance with its associated efficiency improvement.

In contrast to the present invention, prior art systems employ a cooling fluid, typically air, to reduce the diameter of the outer casing and consequently the blade tip clearance. This approach is advantageous to aerogas turbines having a readily available cooling air supply from the ambient and requiring high efficiencies during the start-up transients. However, cooling air is not as readily available to land-based gas turbines.

Figure 1:
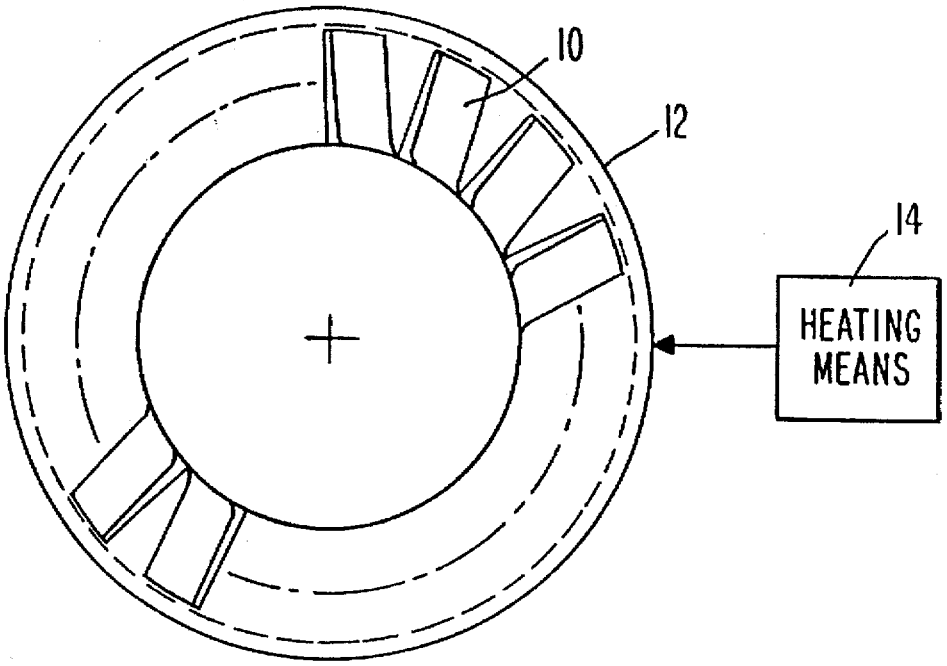
FIG. 1 is a schematic depiction of a blade tip clearance control system in accordance with the present invention.
Figure 2:
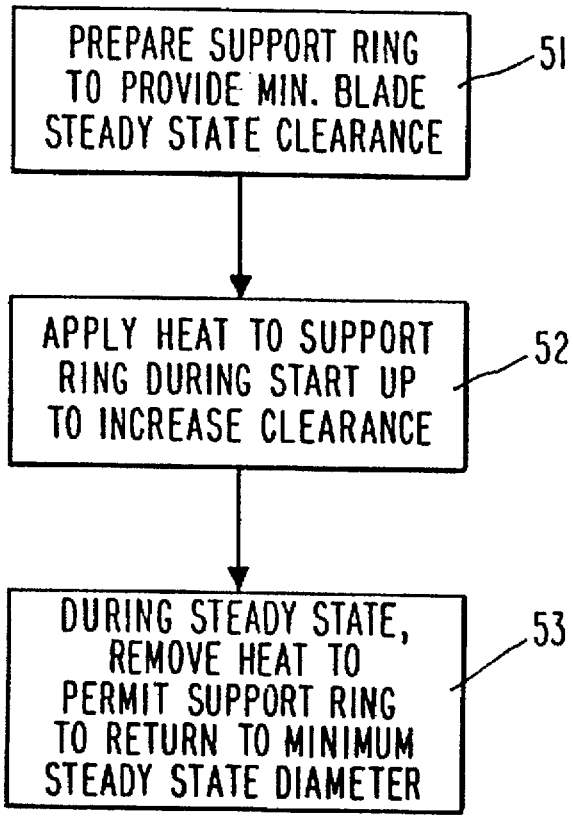
FIG. 2 is a flowchart of a blade tip clearance control method in accordance with the present invention.

One presently preferred embodiment of the present invention is schematically depicted in FIG. 1. As shown, a blade ring 10 is enclosed by a blade support ring 12, and a heating means 12 is coupled to the support ring. As represented by step 51 in FIG. 2, the support ring 12 (FIG. 1) is prepared to provide minimum blade tip clearance during steady state. Subsequently, as represented by step 52, heat is applied to the support ring during a transient period of operation, such as during start-up. This temporarily increases the clearance between the tips of the blades and the support ring. Then, as represented in step 53, the support ring is permitted to return to its original diameter or a diameter reduced from the transient, temporarily expanded diameter.

Figure 3A:
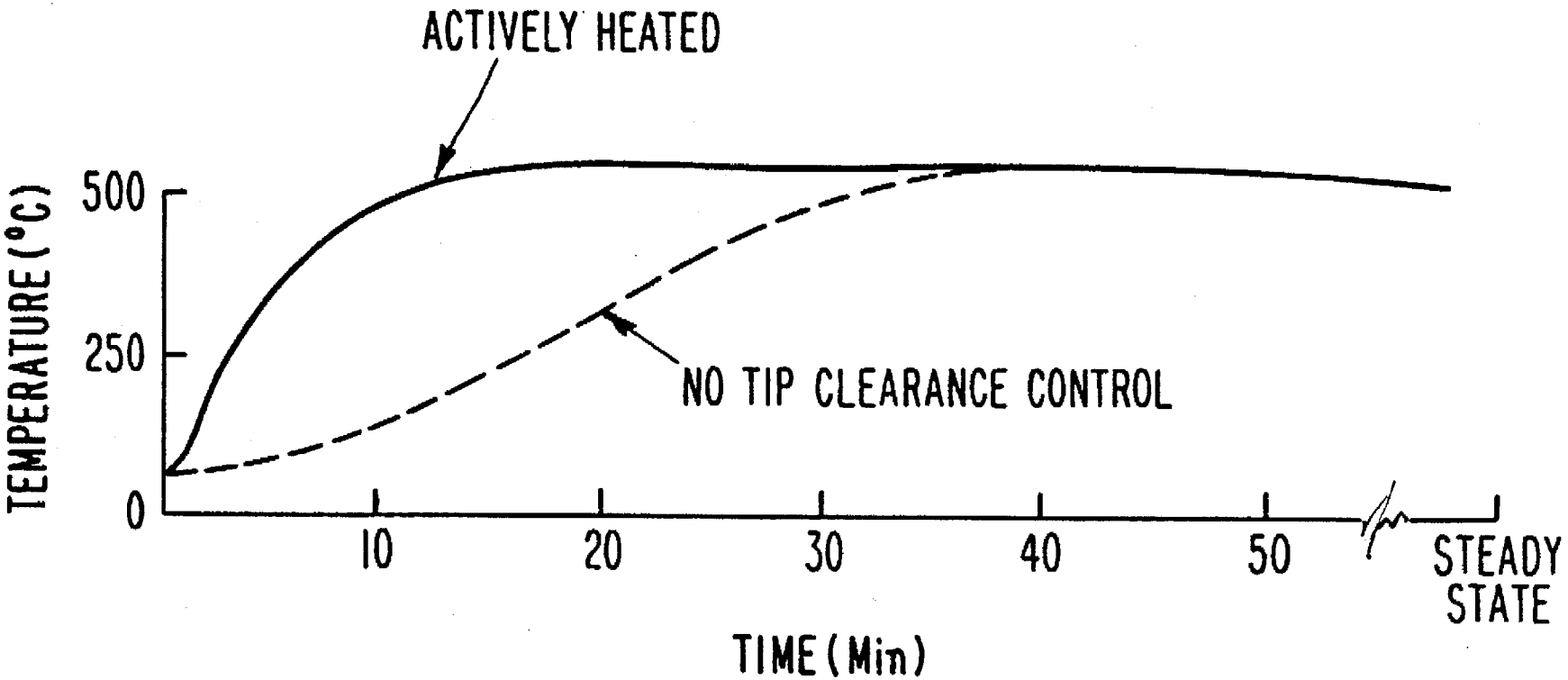
FIG. 3A is a plot of support ring temperature over time with and without the use of the blade tip clearance control method of the present invention.
Figure 3B:
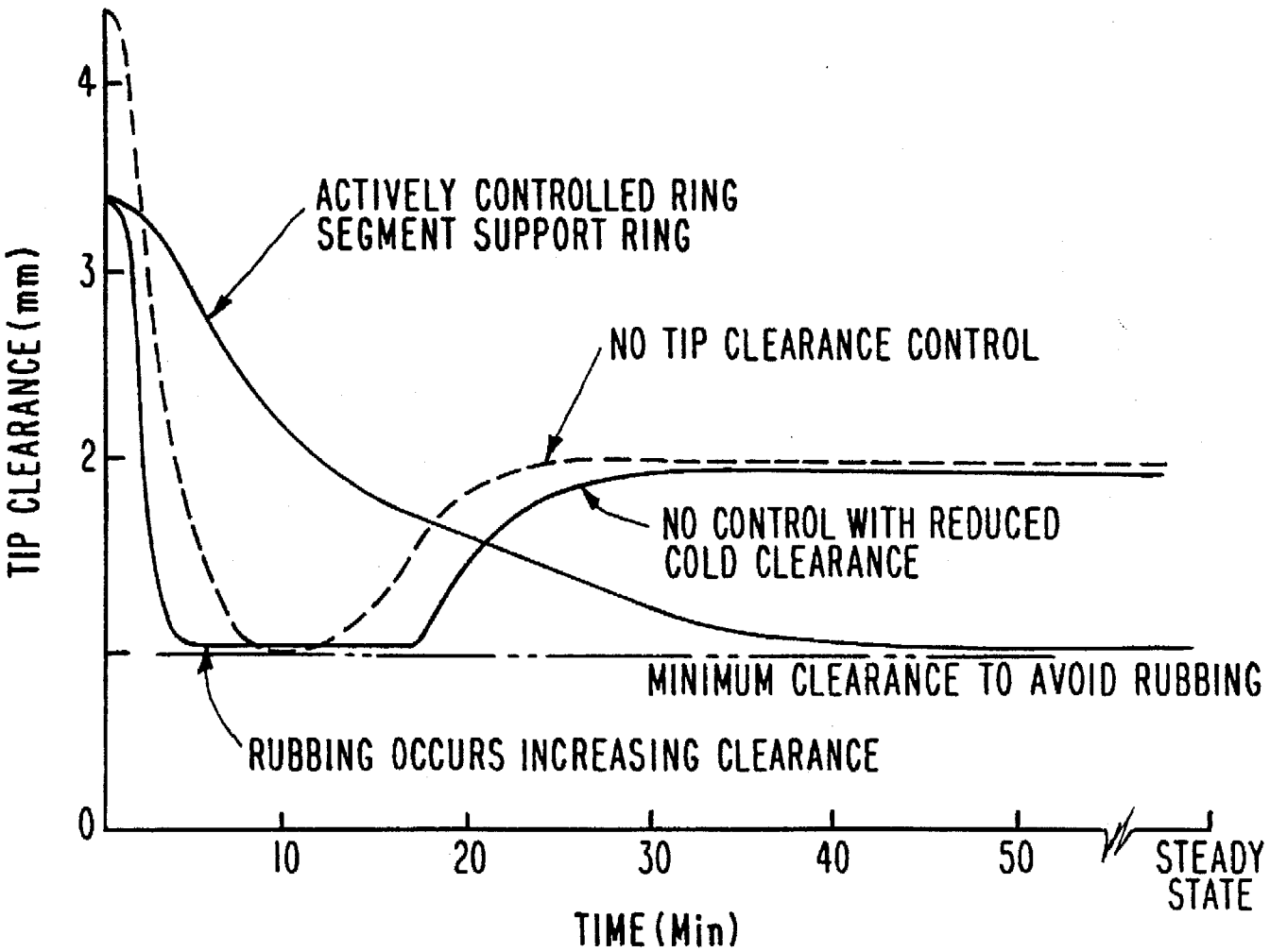
FIG. 3B is a plot of the blade tip clearance over time with and without the use of the blade tip clearance control method of the present invention.

FIG. 3A is a plot of support ring temperature over time with and without the use of the blade tip clearance control method of the present invention, and FIG. 3B depicts a plot of the support ring tip clearance versus time for a start-up transient both with and without the use of the present invention. Note that the steady state clearance reduction is a result of the reduction in cold clearance, and that rubbing occurs when no control is employed with the reduced cold clearance embodiment. Heating is employed only during the transient in order to avoid rubs and therefore does not jeopardize the steady state performance improvement.

In sum, the present invention employs the following methodology: The blade tip cold clearance is reduced at manufacturing such that tip rubbing would normally occur during start-up. The support ring or shroud is heated either before or during the start-up period to increase the transient tip clearance and to avoid rubbing. The external heating is removed during steady state. (FIGS. 3A and 3B graphically depict the effect of this methodology on transient tip clearance.) The present invention requires a means to heat the ring which supports the outer shroud over the blades. The suggested hardware is a shroud support ring and a heating mechanism. Furthermore, the heating system can be a heating fluid such as air or steam, a flame ring, a resistant heater, etc.

The present invention may be practiced in other forms than those specifically described herein, and so the scope of protection of the following claims is not intended to be limited to the presently preferred embodiments.

I claim:

1. A method of improving the efficiency of a gas turbine during steady state operation, said turbine having at least one blade tip and a support member disposed in relation to said blade tip to define a blade tip clearance, comprising the steps of: (a) providing a predetermined minimum blade tip clearance between the at least one blade tip and the support member, (b) controlling said blade tip clearance during a transient, non-steady state period of operation of the turbine such that the predetermined minimum blade tip clearance is substantially maintained during a steady state period of operation of said turbine.

2. A method as recited in claim 1, wherein said blade tip clearance is reduced by heating said support member.

3. A method as recited in claim 1, wherein said turbine is a land-based turbine.

4. A method as recited in claim 1, wherein said turbine comprises a plurality of blades forming a blade ring and said support member comprises a support ring encircling said blade ring.

5. A method as recited in claim 4, wherein said step of reducing said blade tip clearance is performed by heating said support ring.

6. A method as recited in claim 5, wherein said heating is performed with a member of a group consisting of a heating fluid, a flame ring, and a resistant heater.

7. A method as recited in claim 4, wherein said support ring and blade ring are constructed to provide a minimum blade tip clearance during a steady state operation of said turbine.

8. A method as recited in claim 1, wherein said turbine is a land-based turbine; said turbine comprises a plurality of blades forming a blade ring and said support member comprises a support ring encircling said blade ring, and said step of reducing said blade tip clearance is performed by heating said support ring, said heating being performed with a member of a group consisting of a heating fluid, a flame ring, and a resistant heater; and wherein said support ring and blade ring are constructed to provide a minimum blade tip clearance during a steady state operation of said turbine.

9. A gas turbine system comprising a gas turbine having at least one blade tip, a support member having an outside diameter disposed in relation to said blade tip to define a blade tip clearance, and means for controlling said blade tip clearance during a start-up period of operation of the turbine such that a minimum blade tip clearance is provided during a steady state operation of said turbine.

10. A system as recited in claim 9, wherein said means for controlling said blade tip clearance comprises means for heating said support member to increase the outside diameter in relation to an increase in blade length during the start-up period.

11. A system as recited in claim 9, wherein said turbine is a land-based turbine.

12. A system as recited in claim 9, wherein said turbine comprises a plurality of blades forming a blade ring and said support member comprises a support ring encircling said blade ring.

13. A system as recited in claim 12, wherein said means for controlling said blade tip clearance comprises heating means for heating said support ring.

14. A system as recited in claim 13, wherein said heating means comprises a member of a group consisting of a heating fluid, a flame ring, and a resistant heater.

15. A system as recited in claim 14, wherein said turbine is a land-based turbine.

* * * * *